US005314347A

United States Patent [19]

Colleran et al.

[11] Patent Number: 5,314,347

[45] Date of Patent: May 24, 1994

[54] LATCHABLE ELECTRICAL CONNECTOR SYSTEM

[75] Inventors: Stephen A. Colleran, Lisle; Russell L. Mackowiak, Wheaton, both of Ill.; Lorenzo Manassero, Turin, Italy; Uwe Schwartz, Ettlisen, Germany; Bill B. Wilson, Montgomery, Ill.

[73] Assignee: Molex Incorporated, Lisle, Ill.

[21] Appl. No.: 929,610

[22] Filed: Aug. 13, 1992

[51] Int. Cl.[5] ..... H01R 13/627

[52] U.S. Cl. ..... 439/350; 439/352; 439/358

[58] Field of Search ..... 439/345, 350, 352, 357, 439/358

[56] References Cited

U.S. PATENT DOCUMENTS

| | | | |
|---|---|---|---|
| 4,284,313 | 8/1981 | Anhalt | 439/350 |
| 4,441,776 | 4/1984 | Anhalt . | |
| 4,986,766 | 1/1991 | Leonard et al. | 439/352 |
| 5,021,003 | 6/1991 | Ohtaka et al. | 439/357 |
| 5,059,140 | 10/1991 | Philippson et al. | 439/607 |

*Primary Examiner*—Larry I. Schwartz
*Assistant Examiner*—Khiem Nguyen
*Attorney, Agent, or Firm*—A. A. Tirva

[57] ABSTRACT

An unlatching system is provided in a latchable electrical connector system which includes first and second electrical connectors mateable in a given mating direction. The first connector includes a pair of latch devices interengageable with complementary latches on the second connector when the connectors are mated to resist unmating of the connectors. The latch devices are flexible in a direction transverse to the mating direction for movement into and out of latching interengagement with the latches of the second connector. A transversely flexible unlatching mechanism is coupled between the latch devices and is bowed outwardly therefrom, whereby inward flexing of the unlatching mechanism, as by the application of pressure by a user, is effective to cause outward unlatching movement of the latch devices.

5 Claims, 3 Drawing Sheets

LATCHABLE ELECTRICAL CONNECTOR SYSTEM

FIELD OF THE INVENTION

This invention generally relates to the art of electrical connectors and, particularly, to a latchable electrical connector system having improved means for unlatching a pair of mating connectors.

BACKGROUND OF THE INVENTION

Most mating electrical connectors are mated with a push/pull action, such as in mating male and female connectors. It often is desirable to latch the connectors in mated condition to resist or prevent unmating. In some applications, latching devices are designed simply to hold the connectors in mated condition but to allow the connectors to be readily unmated. In other applications, latching devices are designed to prevent unmating of the connectors unless the latching devices, themselves, are physically unlatched. In the latter applications, unlatching of the connectors can be very difficult or cumbersome because of the design of the latching devices or because of the small dimensions of the connectors which render manual manipulation very difficult. In fact, some latching/unlatching mechanisms require a user to physically hold a connector with one hand while unlatching the latch mechanism(s) with the other hand.

There are a wide variety of latching systems for electrical connectors. Many such systems utilize flexible or resilient latch arms, cam latches on flexible walls of a connector, or the like, all of which operate on a sort of resilient snap-lock action. In other words, a pair of electrical connectors will be automatically latched upon mating, and the latching device therefore must be unlatched or released in order to unmate the connectors. If a latching device snaps into a latched position upon mating of the connectors, the latching device must be moved out of its latched condition before the connectors can be unmated. Problems constantly are encountered in effecting unlatching and unmating of the connectors because of unnecessary manual manipulations required.

Latching mechanisms also are prone to cause other problems in the design of electrical connectors. For instance, latching devices often create projections which interfere with or trap extraneous objects, such as electrical wires. Latch arms often are prone to breakage, because the arms often are integrally molded with an electrical connector housing.

This invention is directed to a latchable electrical connector system which solves the above and other problems in many previous latching devices by affording a simple one-hand unlatching action in a mechanism which prevents entanglement of the latching devices with wires or other extraneous objects and which is not prone to breakage.

SUMMARY OF THE INVENTION

An object, therefore, of the invention is to provide a new and improved unlatching means in a latchable electrical connector system.

In the exemplary embodiments of the invention, first and second electrical connectors are mateable in a given mating direction. The first connector includes a pair of latch devices interengageable with complementary latch means on the second connector when the connectors are mated to resist unmating of the connectors. The latch devices are flexible in a direction transverse to the mating direction for movement into and out of latching interengagement with the latch means of the second connector.

The invention contemplates the provision of transversely flexible unlatching means coupled between the latch devices and bowed outwardly therefrom whereby inward flexing of the unlatching means, as by the application of pressure by a user, is effective to cause outward unlatching movement of the latch devices. The invention is disclosed herein in combination with an electrical connector which includes a molded dielectric housing including the latch devices. The unlatching means are integrally molded between the latch devices.

In one embodiment of the invention, the latch devices are formed on a pair of opposite side walls of a connector housing. The unlatching means comprise a flexible band joining the side walls in an outwardly bowed configuration. In other words, the flexible band extends approximately 180° about the connector in an outwardly bowed configuration.

In another embodiment of the invention, the latch devices are formed by flexible cantilevered latch arms extending axially of the connector. The unlatching means are provided by a flexible ring-like member extending 360° about the connector, spaced outwardly therefrom and joining the cantilevered latch arms. The latch arms include latch hooks near the distal ends thereof, and the ring-like member joins the distal ends of the cantilevered latch arms.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
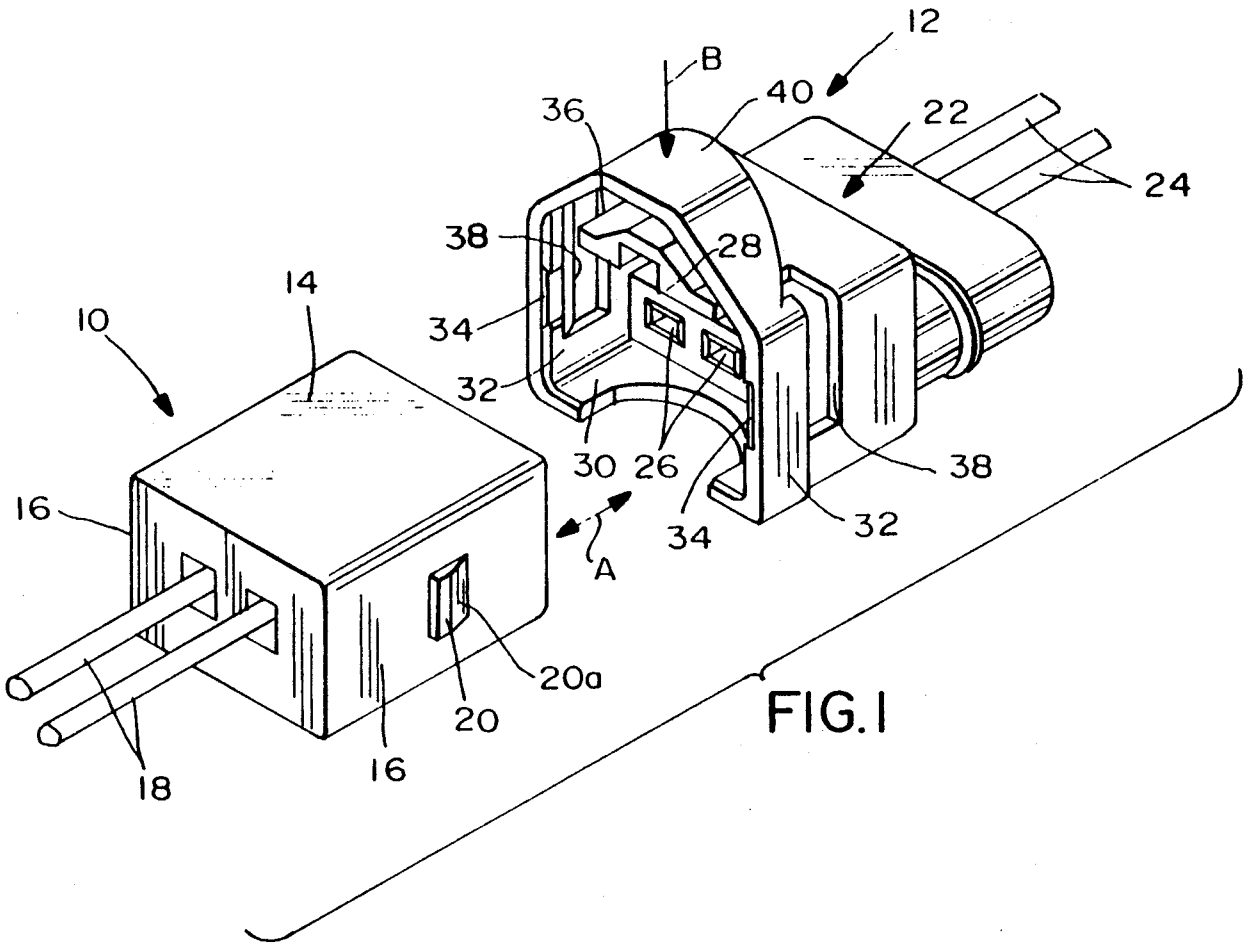
FIG. 1 is a perspective view of one embodiment of a latchable electrical connector system embodying the concepts of the invention.

Referring to the drawings in greater detail, and first to FIG. 1, the invention is illustrated in a first embodiment of the invention which includes a male connector, generally designated 10, mateable with a female connector, generally designated 12. The connectors are mateable and unmateable in a given mating direction, as indicated by double-headed arrow "A". Male connector 10 includes a dielectric housing 14 of a generally rectangular configuration and includes a pair of side walls 16. The housing mounts appropriate terminals (not shown) terminated therein to appropriate electrical wires 18. Housing 14 is unitarily molded of dielectric material, such as plastic or the like, and includes a latch boss 20 projecting outwardly from each side wall 16. Each latch boss includes a forwardly facing ramp or cam surface 20*a*.

Female connector 12 also includes a dielectric housing, generally designated 22, which is unitarily molded of dielectric material, such as plastic or the like. The housing mounts appropriate terminals therewithin, the terminals being terminated to appropriate electrical wires 24. For instance, the terminals may be socket contacts 26 for receiving pin contacts recessed within housing 14 of male connector 10. The unitarily molded housing 22 of female connector 12 includes a top wall 28, a bottom wall 30 and a pair of side walls 32 which cooperate to form a generally rectangular female recess for receiving housing 14 of male connector 10.

Lastly, housing 22 of female connector 12 includes a pair of latch devices 34 projecting inwardly from side wall 32. The latch devices are designed for riding over ramp surfaces 20*a* of latch bosses 20 of male connector housing 14 and to snap-lock behind the bosses 20 when connectors 10 and 12 are fully mated. To this end, it can be seen that side walls 32 are spaced from side edges of top wall 28, as at 36, and openings or windows 38 are provided in the side walls so that flexibility or resiliency is provided for latch devices 34 whereby the latch devices and the surrounding wall portions can yield or flex outwardly (i.e. transversely of mating direction "A") upon mating of the connectors, with the latch devices automatically snapping into locked condition behind latch bosses 20 of male connector 10.

Figure 3:
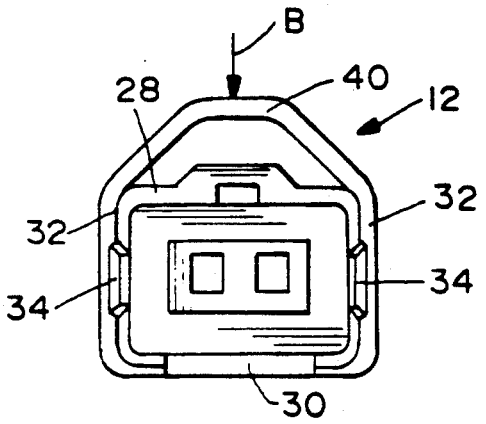
FIG. 3 is an end elevational view of the female connector, looking toward the left-hand end of FIG. 2.
Figure 2:
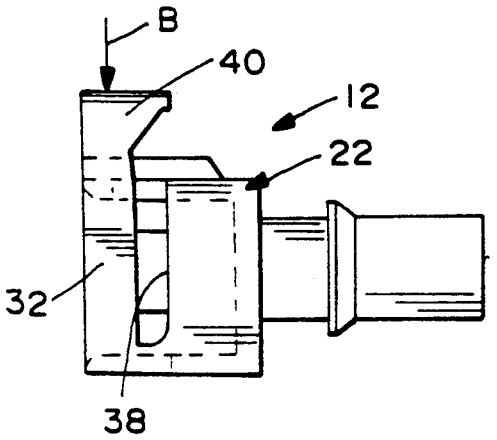
FIG. 2 is a side elevational view of the female connector of FIG. 1.
Figure 4:
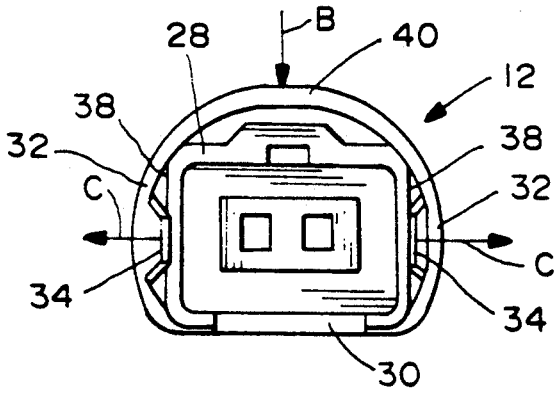
FIG. 4 is an end elevational view similar to that of FIG. 3, but with the unlatching means depressed to afford unlatching of the connectors.

Referring to FIGS. 2–4 in conjunction with FIG. 1, the invention contemplates an improved unlatching means for unlatching the connectors by a user with a single hand manipulating female connector 12 while male connector 10 either is stationary or held with the user's other hand. More particularly, a transversely flexible band 40 is bowed outwardly of the connector and is coupled to or joined with latch devices 34, by integrally molding the unlatching band with the unitarily molded dielectric housing of female connector 12. FIGS. 1 and 3 show unlatching band 40 in its normal or unstressed state, i.e. in an outwardly bowed configuration relative to the connector. FIG. 2 shows how the unlatching band projects upwardly from the connector in its unstressed state. When male and female connectors 10 and 12 are in their mated condition, with latch devices 34 and latch bosses 20 interengaged in latched condition, unlatching band 40 will be in the unstressed state as depicted in FIGS. 1–3.

When it is desired to unlatch the mated connectors, inward pressure is applied to unlatching band 40 in the direction of arrows "B". This can be done by manual manipulation by a user simply by pinching the connector between the user's fingers on top of the band and on the bottom of the connector housing. In fact, the connector can be unlatched and unmated with the same manual manipulatable action of pinching and pulling on the connector.

FIG. 4 shows unlatching band 40 having been depressed in the direction of arrow "B", and a comparison can be made between the depressed unlatching condition of band 40 in FIG. 4 with the outwardly bowed unstressed state of the band in FIG. 3. When the band is depressed (or compressed toward the connector housing) as viewed in FIG. 4, it can be seen that latch devices 34 have been forced outwardly in the direction of arrows "C". By this action, the latch devices have been moved transversely outwardly from their locked condition behind latch bosses 20 of male connector 10, and the male and female connectors can be readily unmated.

Figure 5:
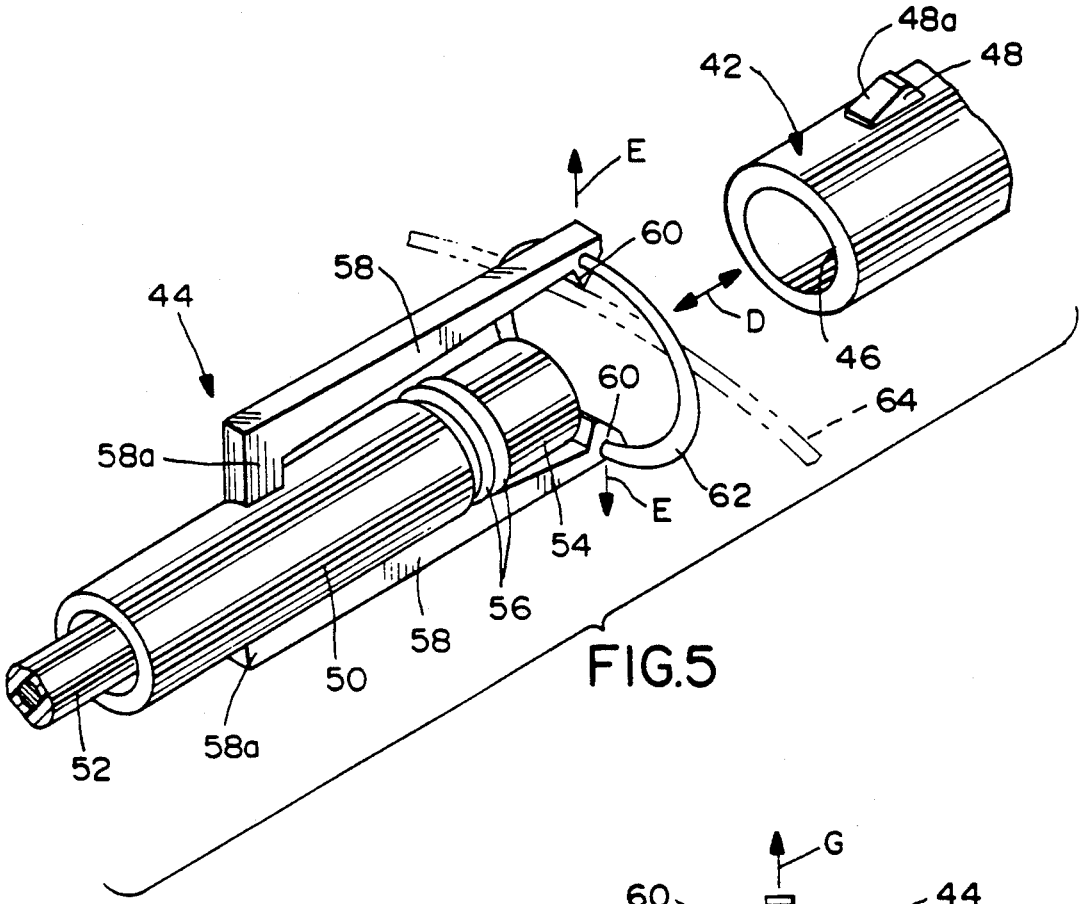
FIG. 5 is a perspective view of a second embodiment of a latchable electrical connector system embodying the concepts of the invention.

FIG. 5 shows the invention incorporated in a second embodiment of the invention which includes a female connector, generally designated 42, and a male connector, generally designated 44. Female connector 42 is shown simply as a cylindrical housing defining a receptacle 46. Similar to latch bosses 20 of male connector 10 in FIG. 1, female connector 42 includes a pair of latch bosses 48 having forwardly facing cam or ramp surfaces 48*a*. The latch bosses project transversely outwardly from opposite diametral sides of the female connector. Connectors 42 and 44 are mated and unmated in the direction of double-headed arrow "D".

Male connector 44 includes a cylindrical housing 50 mounting appropriate terminals therewithin for termination to an electrical cable 52. A forward mating end 54 of the connector is sized for insertion into receptacle 46 of female connector 42. A pair of seal rings 56 may be provided for sealing between the forward mating portion and the inside of the receptacle.

Male connector 44 is provided with latch means in the form of a pair of forwardly projecting flexible cantilevered latch arms 58 unitarily molded at their proximal ends 58*a* to housing 50 and defining latch hook portions 60 at their distal ends. When male connector 54 is mated with female connector 42, hook portions 60 of cantilevered latch arms 58 ride over ramp surfaces 48*a* of latch bosses 48 of female connector 52, and the hook portions will snap-lock automatically behind the latch bosses. In other words, due to the flexibility of cantilevered latch arms 58, hook portions 60 will move transversely outwardly in the direction of arrows "E" and then automatically snap back behind latch bosses 48.

The unlatching means of the embodiment of the invention shown in FIG. 5 is provided by a flexible ring-like unlatching member 62 coupled between or joining cantilevered latch arms 58 at their distal ends, i.e. joining the hook portions 60 of the respective latch arms. Flexible ring 62 can be molded integrally with and between the distal ends of the latch arms, or the ring could be provided by a separate flexible plastic component running through appropriate holes in the distal ends of the latch arms. Regardless, the unlatching ring is transversely flexible relative to the mating direction of the connectors as indicated by double-headed arrow "D".

Figure 6:
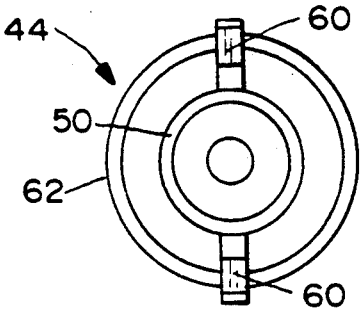
FIG. 6 is an end elevational view looking toward the right-hand end of the male connector of FIG. 5, with the latch devices in latching condition.

FIG. 6 shows the outwardly bowed configuration of unlatching ring 62, i.e. in its natural or unstressed state. This is the configuration of the latch ring when hook portions 60 of latch arms 58 are snap-locked behind latch bosses 48 of female connector 42.

Figure 7:
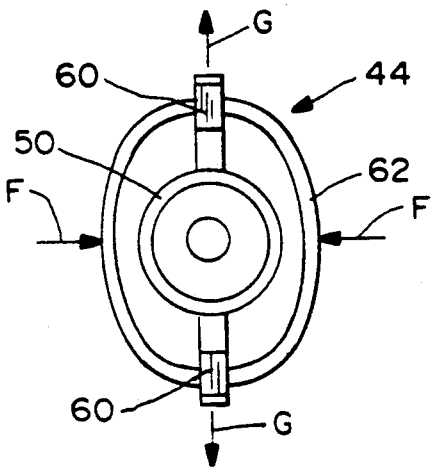
FIG. 7 is an end elevational view similar to that of FIG. 6, with the unlatching ring deformed to unlatch the latch devices.

When it is desired to unmate connectors 42 and 44, and referring to FIG. 7, a user simply applies inward pressure to unlatching ring 62 in the direction of arrows "F". In comparing FIG. 7 with FIG. 6, it can be seen that hook portions 60 of latch arms 58 have been moved outwardly in the direction of arrows "G". In other words, the hook portions have been moved out of latched or locked condition with latch bosses 48 of the female connector in response to pinching inwardly on unlatching ring 62, preferably at locations spaced 90° from the latching hook portions. It can be seen that, like the embodiment of FIGS. 1–4, a user simply can grasp male connector 50 with his fingers pinching inwardly on unlatching ring 62 and simultaneously unlatch the connectors and unmate the connectors in a single pinching and pulling action.

Unlatching ring 62 in the embodiment of FIGS. 5–7 also affords other advantages. As stated in the "Background", above, many electrical connectors utilize cantilevered latch arms as their latching mechanisms. These arms are prone to become broken or bent. Ring 62 prevents the latch arms from being outwardly overstressed (which would lose their flexibility) and also prevents the latch arms from being completely broken away from the male connector. Still further, and referring to FIG. 5, extraneous objects, such as a wire 64, are prone to become entangled or trapped behind latch arms of connectors heretofore available. Ring 62 prevents extraneous objects from riding under the latch arms.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a latchable electrical connector system which includes first and second electrical connectors matable in a given mating direction, the first connector including a pair of latch devices cantileverly attached to said first connector and interengageable with complementary latch means on the second connector when the connectors are mated to resist unmating of the connectors, the latch devices being flexible in a direction transverse to said mating direction for movement into and out of latching interengagement with the latch means of the second connector, wherein the improvement comprises transversely flexible unlatching means coupled between the latch devices and bowed outwardly from the mating direction whereby inward flexing of the unlatching means towards the mating direction at a single point of the unlatching means, as by the application of pressure by a user, is effective to cause outward unlatching movement of the latch devices.

2. In a latchable electrical connector system as set forth in claim 1, wherein at least the first electrical connector includes a molded dielectric housing including said latch devices, and said unlatching means are integrally molded between the latch devices.

3. In a latchable electrical connector system as set forth in claim 2, wherein said latch devices are formed on a pair of opposite side walls of the housing, and said unlatching means comprise a flexible band joining the side walls in an outwardly bowed configuration.

4. In a latchable electrical connector system as set forth in claim 1, wherein said latch devices are located on diametral opposite sides of the first connector, and said unlatching means extend on the order of 180° about the first connector in an outwardly bowed configuration.

5. In a latchable electrical connector system which includes first and second electrical connectors matable in a given mating direction, the first connector including a latch device cantileverly attached to said first connector and interengageable with a complementary latch means on the second connector when the connectors are mated to resist unmating of the connectors, the latch device being flexible in a direction transverse to said mating direction for movement into and out of latching interengagement with the latch means of the second connector, wherein the improvement comprises a transversely flexible unlatching mechanism joined to the latch device of the first connector and projecting outwardly from the mating direction and configured so that inward flexing of the unlatching mechanism towards the mating direction at a single point of the unlatching mechanism, as by the application of pressure by a user, is effective to cause outward unlatching movement of the latch device.

* * * * *